US012414629B2

(12) United States Patent
Stoltzfus et al.

(10) Patent No.: US 12,414,629 B2
(45) Date of Patent: Sep. 16, 2025

(54) FIRE PIT FURNITURE

(71) Applicant: Breeo, LLC, Kinzers, PA (US)

(72) Inventors: Amos A. Stoltzfus, Gordonville, PA (US); Jonathan C. Miller, New Providence, PA (US); Amos Alan Allgyer, Gordonville, PA (US); Christopher Boehmer, Shohola, PA (US)

(73) Assignee: Breeo, LLC, Kinzers, PA (US)

( * ) Notice: Subject to any disclaimer, the term of this patent is extended or adjusted under 35 U.S.C. 154(b) by 148 days.

(21) Appl. No.: 18/128,516

(22) Filed: Mar. 30, 2023

(65) Prior Publication Data

US 2023/0404263 A1 Dec. 21, 2023

Related U.S. Application Data

(60) Provisional application No. 63/412,258, filed on Sep. 30, 2022, provisional application No. 63/352,705, filed on Jun. 16, 2022.

(51) Int. Cl.
*A47C 1/00* (2006.01)
*A47B 31/00* (2006.01)
(Continued)

(52) U.S. Cl.
CPC ..... *A47C 1/00* (2013.01); *A47B 31/00* (2013.01); *A47C 7/541* (2018.08); *A47C 7/70* (2013.01); *A47B 2031/003* (2013.01)

(58) Field of Classification Search
CPC .. A47C 1/00; A47C 1/06; A47C 7/541; A47C 7/70; A47C 7/705; A47C 7/624; A47B 31/00; A47B 2031/003; A47B 23/02; A47B 13/16; A47B 2200/0085; A47B 83/02
USPC ..... 108/28, 11, 12, 18, 25, 26, 44, 46, 47, 108/50.14, 157.16, 97, 98; 297/162, 297/188.14, 161, 170, 173, 188.18, 145,
(Continued)

(56) References Cited

U.S. PATENT DOCUMENTS 979,070 A * 12/1910 Hoffman
D78,926 S 7/1929 Gottlob
(Continued)

FOREIGN PATENT DOCUMENTS

KR 100779391 B1 * 11/2007

OTHER PUBLICATIONS

Breeo LLC, May 6, 2022, Youtube, Breeo X Series Furniture: Pro-Team Testimonial, https://www.youtube.com/watch?v=068s71NFxQQ.

(Continued)

*Primary Examiner* — Janet M Wilkens
(74) *Attorney, Agent, or Firm* — Fred Zollinger

(57) ABSTRACT

Furniture useful around fire pits include an accessory mount to allow items such as a tray or grill to be mounted to the furniture in both useful and storage positions. The accessory mount is repositionably carried on an armrest or table edge. The position of the mount can be changed along the length of the armrest or table edge. The mount assembly allows the accessory to pivot when in the useful position. A cup holder also can be repositionably carried by the armrest or the table edge. A table has storage areas for a fire pit griddle and fire pit cover.

19 Claims, 13 Drawing Sheets

(51) Int. Cl.
*A47C 7/54* (2006.01)
*A47C 7/70* (2006.01)

(58) Field of Classification Search
USPC ..... 297/153, 188.15, 188, 2; 248/235, 241, 248/250
See application file for complete search history.

(56) References Cited

U.S. PATENT DOCUMENTS

| | | | | |
|---|---|---|---|---|
| 2,118,676 | A | 5/1938 | Lankton | |
| 2,490,884 | A | 12/1949 | Rau | |
| 2,600,626 | A | 6/1952 | Ellingson | |
| 2,710,051 | A * | 6/1955 | Greenberg | A47C 7/70 297/170 |
| 2,720,913 | A | 10/1955 | Hoppert | |
| 3,271,070 | A * | 9/1966 | Dlouhy | A47C 1/06 108/26 |
| 4,575,149 | A * | 3/1986 | Forestal | A47B 23/02 248/240.4 |
| 5,050,929 | A | 9/1991 | Gueringer et al. | |
| 5,120,071 | A | 6/1992 | Thibault et al. | |
| D334,299 | S | 3/1993 | Embree | |
| D350,860 | S | 9/1994 | Greeson | |
| 5,451,092 | A | 9/1995 | Gray | |
| 5,899,526 | A * | 5/1999 | LaPointe | A61G 5/10 297/188.2 |
| 6,017,085 | A * | 1/2000 | LaCroix | A47C 7/70 297/173 |
| D509,970 | S | 9/2005 | Adams | |
| 7,131,688 | B2 * | 11/2006 | Steenson | A47C 7/70 108/157.11 |
| 7,506,923 | B1 | 3/2009 | Gauss | |
| 7,740,312 | B2 * | 6/2010 | Johnson, Jr. | A47B 83/02 297/217.6 |
| 8,025,015 | B1 * | 9/2011 | Kennedy, Sr. | B60R 11/0252 248/562 |
| D660,040 | S | 5/2012 | Bogdan et al. | |
| 8,419,124 | B2 | 4/2013 | Kramer et al. | |
| 8,596,206 | B2 | 12/2013 | Legeay | |
| D712,172 | S | 9/2014 | Saylor | |
| 8,905,471 | B2 | 12/2014 | Tang | |
| D752,354 | S | 3/2016 | Fairbanks | |
| D777,465 | S | 1/2017 | Milde | |
| 9,820,568 | B2 | 11/2017 | Johnson | |
| 9,924,805 | B2 | 3/2018 | Cass | |
| D836,931 | S | 1/2019 | Prokofiev | |
| D853,142 | S | 7/2019 | Tao | |
| D899,801 | S | 10/2020 | White, III et al. | |
| 10,842,262 | B2 * | 11/2020 | Zimmerman | A47B 1/04 |
| D906,713 | S | 1/2021 | White, III et al. | |
| D929,761 | S | 9/2021 | Xiao | |
| D972,321 | S | 12/2022 | Schaeffer | |
| D972,324 | S | 12/2022 | Schaeffer | |
| D981,744 | S | 3/2023 | Wu | |
| 11,644,241 | B2 | 5/2023 | Zemel et al. | |
| D995,135 | S | 8/2023 | Zhaowen | |
| 2005/0067865 | A1 | 3/2005 | Yu | |
| 2007/0114755 | A1 | 5/2007 | Pasternak et al. | |
| 2008/0164729 | A1 | 7/2008 | Cavanaugh | |
| 2009/0284030 | A1 * | 11/2009 | Rein | B60R 11/00 293/142 |
| 2013/0200229 | A1 | 8/2013 | Corey et al. | |
| 2016/0022043 | A1 | 1/2016 | Czumaj-Bront | |
| 2020/0022498 | A1 | 1/2020 | Howell | |
| 2021/0007495 | A1 | 1/2021 | Snir et al. | |
| 2022/0282923 | A1 | 9/2022 | Zemel et al. | |

OTHER PUBLICATIONS

Breeo LLC, Apr. 29, 2022, Youtube, X Series Furniture FAQ, https://www.youtube.com/watch?v=iQbGAfPVmMY.
Breeo LLC, Apr. 29, 2022, Youtube, X Series Furniture, https://www.youtube.com/watch?v=MNjGQ15a0_k.
Breeo LLC, Apr. 27, 2022, Youtube, Why Breeo Made Fireside Furniture, https://www.youtube.com/watch?v=9wU6UFsy-M8.
Breeo LLC, Apr. 25, 2022, Instagram, 9 images, https://www.instagram.com/p/CcyOSbNpg2N/?utm_source=ig_web_copy_link.
Breeo LLC, Apr. 22, 2022, Instagram, https://www.instagram.com/tv/CcqNGQalDIA/?utm_source=ig_web_copy_link.
Breeo LLC, Apr. 23, 2022, Instagram, https://www.instagram.com/tv/CcswW3sIJOQ/?utm_source=ig_web_copy_link.
Breeo LLC, Apr. 24, 2022, Instagram, https://www.instagram.com/tv/CcvVdkZI_fl/?utm_source=ig_web_copy_link.
Breeo LLC, Apr. 24, 2022, Instagram, https://www.instagram.com/tv/CcvVdkZl_fl/?utm_source=ig_web_copy_link.
Breeo LLC, Apr. 29, 2022, Instagram, https://www.instagram.com/tv/Cc8hBwxJx_E/?utm_source=ig_web_copy_link.
Breeo LLC, Sep. 12, 2022, Instagram, https://www.instagram.com/p/CiaptmJg5s/.
Stoltzfus et al., Design U.S. Appl. No. 29/842,831, filed Jun. 16, 2022.

* cited by examiner

FIRE PIT FURNITURE

CROSS REFERENCE TO RELATED APPLICATIONS

This application claims the benefit of United States Provisional Patent Application Nos. 63/352,705 filed Jun. 16, 2022 and 63/412,258 filed Sep. 30, 2022; the disclosures of both applications are incorporated herein by reference.

BACKGROUND OF THE DISCLOSURE

1. Technical Field

The disclosure relates to furniture and, more particularly, to furniture with features useful when being used around an outdoor fire pit.

2. Background Information

People enjoy sitting in a ring of chairs about a camp fire provided in a fire pit. Eating and drinking while sitting around a fire pit can be more challenging. Although many chairs have flat armrests on which a bottle or a glass may be balanced, the armrests are not always level. Further, balancing a drink on one armrest while cutting a steak on a plate that is balanced on the other armrest is fraught with the risk of losing the steak or the drink to the ground. Those who enjoy cooking on fire pits and eating the food while enjoying the fire desire furniture that accommodates eating and drinking.

Other issues with using fire pits is the need to continuously add wood to maintain the fire, the need to store the cover for the fire pit, the lid for the fire pit, and the need to store a hot grill if the grill is removed after cooking.

SUMMARY OF THE DISCLOSURE

The disclosure provides items of furniture that support a repositionable and storable accessory such as a tray that can be used to support a plate of food that is being consumed by the person sitting on the furniture. In one configuration, the disclosure provides an armrest configuration that is part of an item of furniture such as a chair, bench, swing, glider, or the like. A mount assembly is repositionably carried on the armrest. In the exemplary configuration, the mount is repositionable because it can be slid along the length of the armrest and locked in a desirable position. The mount assembly provides at least two positions for a tray. In the exemplary configuration, the mount assembly provides a storage position and a repositionable usable position. When the user is sitting on the furniture, the user can place the tray on the mount assembly in the usable position to support a plate of food. The user can slide the mount assembly along the armrest to move the tray closer and farther from the user. Further, in the exemplary configuration, the mount assembly allows the tray to pivot with respect to the mount.

The mount assembly includes a U-shaped bracket that closely fits around three sides of the armrest and slides along the length of the armrest. A locking finger is used to lock the position of the bracket with respect to the armrest. In the exemplary configuration, the mount assembly includes a first mount and a second mount carried by the bracket. The tray can be received on and carried by the first mount with a friction fit to place the tray in the usable position. The tray can be received on and carried by the second mount to place the tray in the storage position. When the armrest is horizontal, the first mount is vertical and the second mount is horizontal. Both mounts can be cylindrical to allow the tray to pivot with respect to the mount in both positions. The tray defines a mounting hole that is sized to frictionally engage both the first and second mounts while allowing the user to remove the tray from one mount and move it to another.

In the exemplary configuration, the armrest defines a slot which, in the exemplary configuration, is defined by the armrest to open at least through the bottom surface of the armrest. Alternatively, the slot also can extend through the front end of the armrest. In another configuration, the slot also extends through the rear end of the armrest or also extends through both the front and rear ends of the armrest. In a further configuration, the slot is open through the upper surface of the armrest. In one configuration, the slot is a groove of substantially constant width. In the exemplary configuration, the slot is T-shaped with the neck of the slot that is open through the bottom surface of the armrest having a width that is smaller than the top portion of the slot. The mount assembly is repositionably carried by the armrest with the locking finger extending into the slot. The user can adjust the locking finger to clamp the mount assembly to the armrest and lock the position of the mount assembly with respect to the armrest. The locking finger can be threaded to the bracket. When the slot is not used, the locking finger engages on of the armrest surfaces, for example, the lower surface of the armrest instead of the interior of the slot. When the slot is used, the locking finger provides additional stability to the mount assembly.

The disclosure also provides a furniture configuration wherein a tray can be carried on both armrests. Further, when a tray is carried by one armrest, a cup holder can be carried by the other armrest using the same type of mounting bracket with the slot defined by the armrest. In an exemplary configuration, the disclosure provides a cup holder having at least a large opening for a can or cup and at least a small opening for stemware wherein the small opening is open to an edge of the cup holder.

The disclosure also provides an item of furniture such as a table that receives the mounting assembly for either or both of the cup holder and tray.

The disclosure further provides a grill mount that is used with an item of furniture such as a table to support a grill for food preparation or food serving. The grill mount includes a first vertical grill mount that holds the grill in a horizontal configuration while allowing the grill to rotate 360 degrees on the mount. In this condition, the grill can be loaded with food before being placed over the fire or the grill can be held while cooked food is served. The grill mount also includes a second horizontal grill mount that holds the grill in a vertical storage position where it is out of the way and can cool.

The disclosure provides a table having a support structure that defines storage areas for a grill cover and one of a grill and griddle. The table also can have a storage area for wood and a shelf for other items. These can be provided individually or all combined in a single table. In an exemplary configuration, the table includes a metal rack and heat shield which are configured to support a hot grill or griddle that is used with a fire pit.

The individual features described below may be combined in different combinations than specifically described below to form different configurations of the devices of the disclosure. The preceding non-limiting aspects of the disclosure, as well as other aspects, are more particularly described below. A more complete understanding of the devices, assemblies, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE DRAWINGS

FIG. 11 is a perspective view of another grill mount for the table.

DETAILED DESCRIPTION OF THE DISCLOSURE

Figure 1:
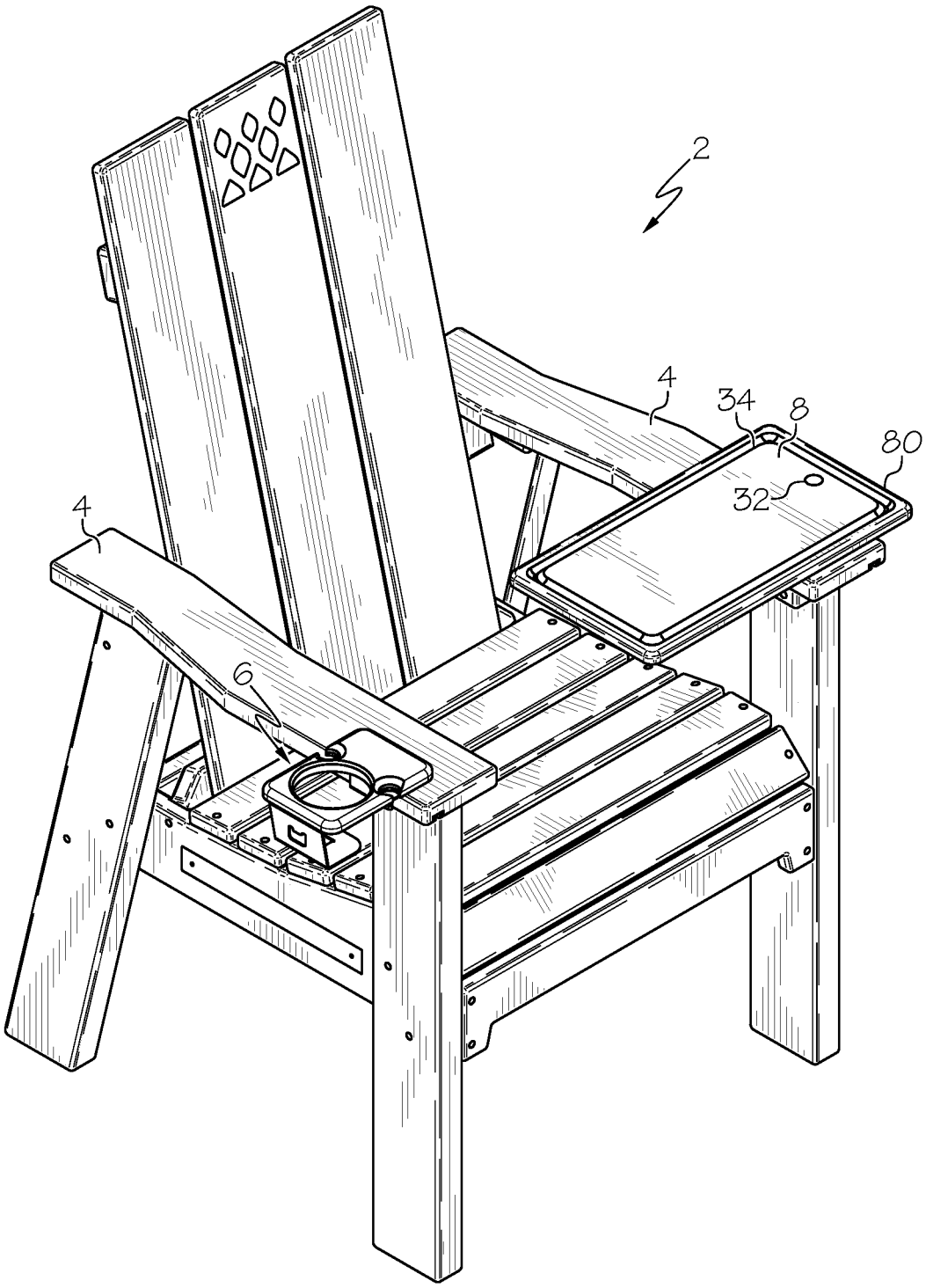
FIG. 1 is a perspective view of a chair with a tray in a first position on one armrest and a cup holder on the other armrest.

This description of exemplary embodiments is intended to be read in connection with the accompanying drawings, which are to be considered part of the entire written description. The drawing figures are not necessarily to scale and certain features may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "joined," "connected," and "interconnected," refer to a relationship wherein structures are secured or attached to one another either directly or indirectly through intervening structures, as well as both movable or rigid attachments or relationships, unless expressly described otherwise.

Figure 2:
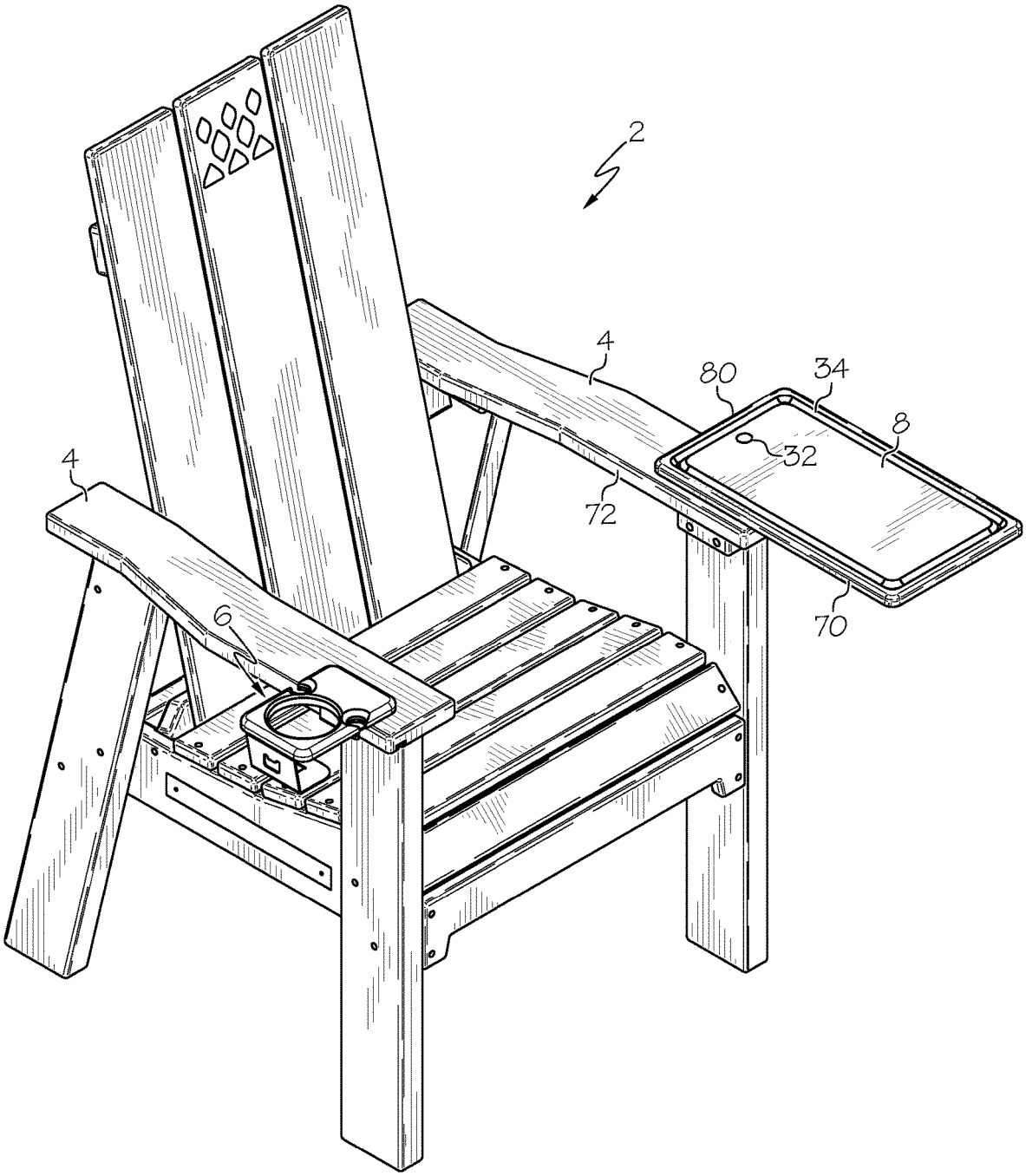
FIG. 2 is a view of the chair of FIG. 1 with the tray in a second position.
Figure 3:
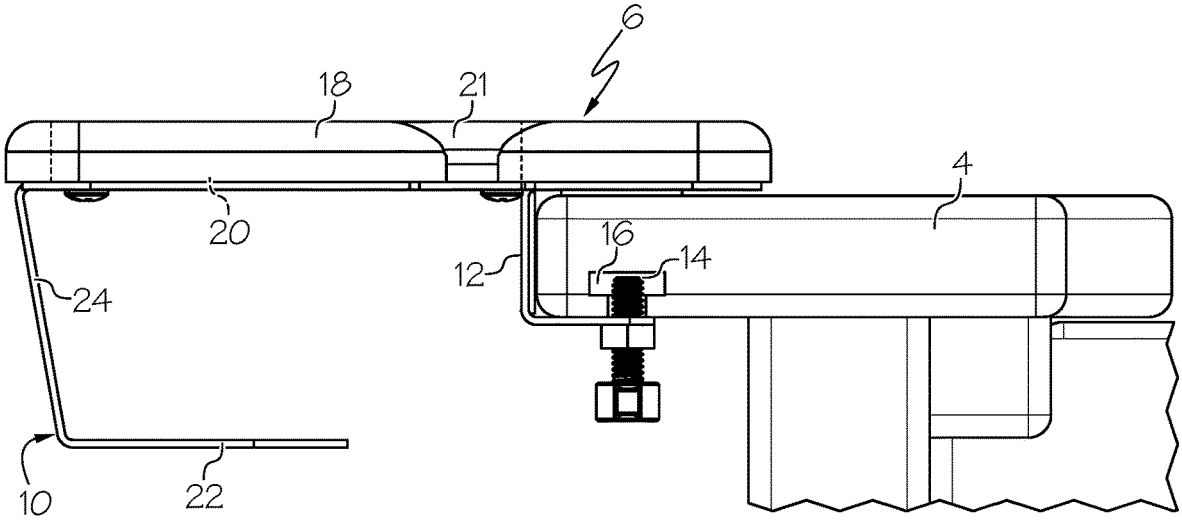
FIG. 3 is an end view of the cup holder mounted to the armrest.

An exemplary item of furniture is a chair 2 depicted in FIGS. 1 and 2. The body of chair 2 includes two armrests 4. The body of chair 2 also includes a support structure that includes a seat, a back, and four legs that allow chair 2 to function to support a person in a sitting position. Armrests 4 depicted with chair 2 in these drawings can be used with other items of furniture including those that are sat on such as couches, swings, and benches.

In the exemplary configuration, a cup holder 6 and a tray 8 are each selectively repositionably carried by armrests 4. Each can be repositioned such as by sliding along at least a majority of the length of armrest 4. When not repositioned by sliding, cup holder 6 or tray 8 can be removed from armrest 4, moved along the length of armrest 4, and reconnected at a different location along armrest 4. Additionally, tray 8 can be pivoted between at least the two positions depicted in FIGS. 1 and 2. Further, tray 8 can be removed from the usable position shown in FIGS. 1 and 2 and moved to a storage position shown in FIG. 5. When the user is sitting on chair 2, the user places tray 8 in its usable position wherein tray 8 is parallel to the top of armrest 4 which is desirably substantially horizontal. The user can then use tray 8 to support a plate of food, a laptop computer, a pad of paper, a game, or a drinking cup or bottle. The user can pivot tray 8 at least from the position of FIG. 1 to the position of FIG. 2 to allow the user to easily get up from chair 2 or sit down in chair 2. In the exemplary configuration, tray 8 can rotate 360 degrees about its mount axis.

Cup holder 6 is mounted to armrest 4 with a mounting assembly 10. Mounting assembly 10 includes a U-shaped bracket 12 that closely fits over at least portions of three surfaces of armrest 4 to frictionally engage armrest 4 while allowing bracket 12 to slide along the length of armrest 4. A locking finger 14 is carried by bracket 12 and is movable to an engaged condition to lock the position of bracket 12 with respect to armrest 4. In this configuration, locking finger 14 is a threaded fastener that threadedly engages bracket 12. Locking finger 14 can engage the lower surface of armrest 4. In the exemplary configuration, armrest 4 defines a slot 16 with locking finger 14 extending into slot 16. Slot 16 can be a channel having a constant width or the T-shaped slot depicted in the drawings. With either shape, the width is configured to cooperate with the diameter of locking finger 14 to provide some support to locking finger 14 when it is in slot 16. With the T-shaped slot 16, a nut can be carried on the locking finger within the wide portion of the slot to create a clamping force between the nut and bracket 12 when locking finger 14 is tightened. Also, the T-shaped slot can be used with third party accessories that fit in such T-shaped slots such as phone holders or tablet holders.

Cup holder 6 includes a body 18 carried above bracket 12. Body 18 defines an opening 20 sized for bottles, wine glasses, cans, cups, and many drinking glasses. In addition, body 18 defines at least one stemware holder opening 21 which is open to an edge of body 18. Opening 21 allows a glass such as a stemmed wine glass to be stably held with the stem in opening 21 and the bowl of the glass resting on body 18. Two openings 21 can be provided. A support 22 is carried by bracket 12 or integral therewith and has a portion located directly below opening to support the bottom of the item placed in cup holder 6. Mounting assembly 10 can be metal and define an opening aligned with opening 20. The side offset portion 24 of support 22 can define a bottle opener (shown in FIGS. 1 and 2).

Tray 8 has a generally flat body that defines a mounting opening 32. In a situation where the user will eat food directly from tray 8, a drip channel 34 is defined by the upper surface of the body. When the tray body is removed from the mounting assembly 40, the tray body can be placed in a dishwasher. The tray body can be made from a polymer or a polymer lumber.

As noted above, mounting assembly 40 allows tray 8 to rotate 360 degrees when tray 8 is in the usable position. Mounting assembly 40 also provides a storage position for tray (FIG. To provide both tray positions, mounting assembly 40 provides first 42 and second 44 mounts carried by a bracket 46 that is supported by armrest 4. As described above with respect to cup holder 6, bracket 46 is generally U-shaped when viewed from the end as in FIGS. 4 and 5 with bracket engaging at last portions of three surfaces of armrest 4. When bracket 46 is placed on armrest 4 and the armrest 4 is substantially horizontal, first mount 42 is substantially vertical and second mount is substantially horizontal. In the exemplary configuration, second mount 44 extends from the side 48 of bracket 46 and first mount 42 extends up from second mount 44. In other configurations, second mount 44 can extend from first mount 42. In another configuration, first mount 42 can extend from the upper arm 50 of bracket 46 and second mount 44 can extend from side 48. A benefit of having first mount 42 extend from second mount 44 is that first mount 42 is located outwardly of the outer edge of armrest 4 and is up against the upper portion of tray 8 when tray 8 is in the storage position. To place tray 8 in the storage position, the user removes tray 8 from first mount 42 and places it on second mount 44. Opening 32 is sized to cause the body of tray 8 to fictionally engage each mount 42 and 44. In the exemplary configuration, tray body 30 is made from a polymer lumber with mounts 42 and 44 being stainless steel cylinders.

A locking finger 60 is carried by bracket 46 and is movable to an engaged condition to lock the position of bracket 46 with respect to armrest 4. In this configuration, locking finger 60 is a threaded fastener that threadedly engages bracket 46. A nut 62 is welded to the bottom of bracket 46 to threadedly receive locking finger 60. Locking finger 60 can engage the lower surface of armrest 4. In the exemplary configuration, armrest 4 defines a slot 16 with locking finger 60 extending into slot 16. Slot 16 can be a channel having a constant width or the T-shaped slot depicted in the drawings. With either shape, the width is configured to cooperate with the diameter of locking finger 60 to provide some support to locking finger 60 when it is in slot 16. With the T-shaped slot 16, a nut can be carried on the locking finger within the wide portion of the slot to create a clamping force between the nut and bracket 12 when locking finger 14 is tightened.

The center of opening 32 defined by the tray body is spaced from the inner edge 70 of the tray body by a distance that is less than the distance from the center of first mount 42 and the inner edge 72 of armrest 4. As such, tray 8 can be rotated to the position of FIG. 2 wherein inner edge 70 is located outward of inner edge 72 so that tray 8 does not interfere with a person sitting down or standing up. When opening 32 is centered in tray body 30, then tray 8 can be rotated 180 degrees from the position of FIG. 2 also without interfering with the opening to chair 2.

Figure 4:
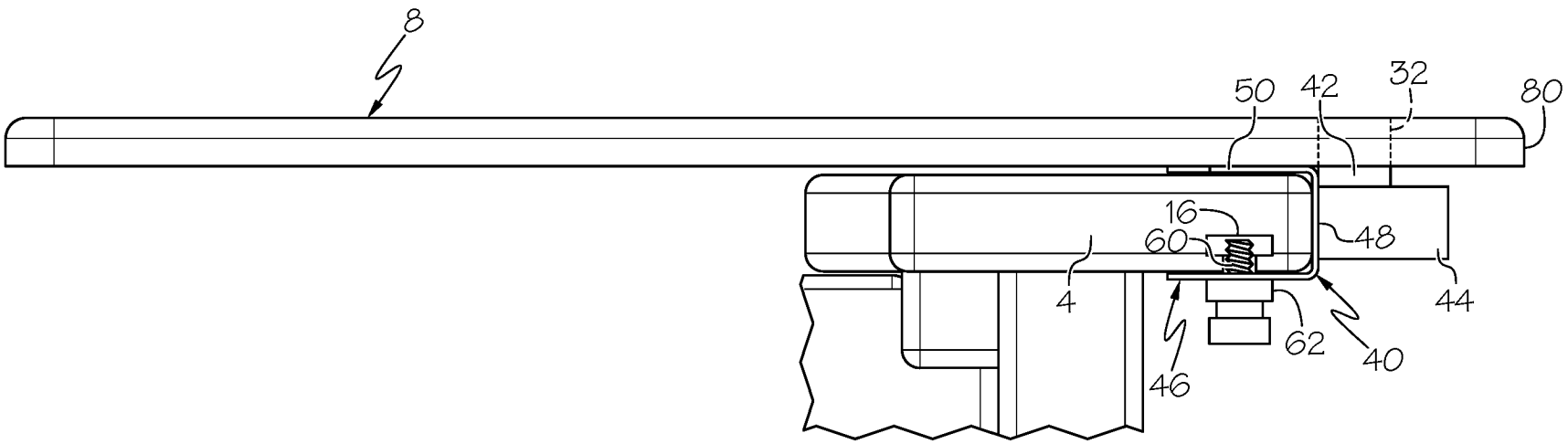
FIG. 4 is an end view of the tray mounted to the armrest in the usable position.
Figure 5:
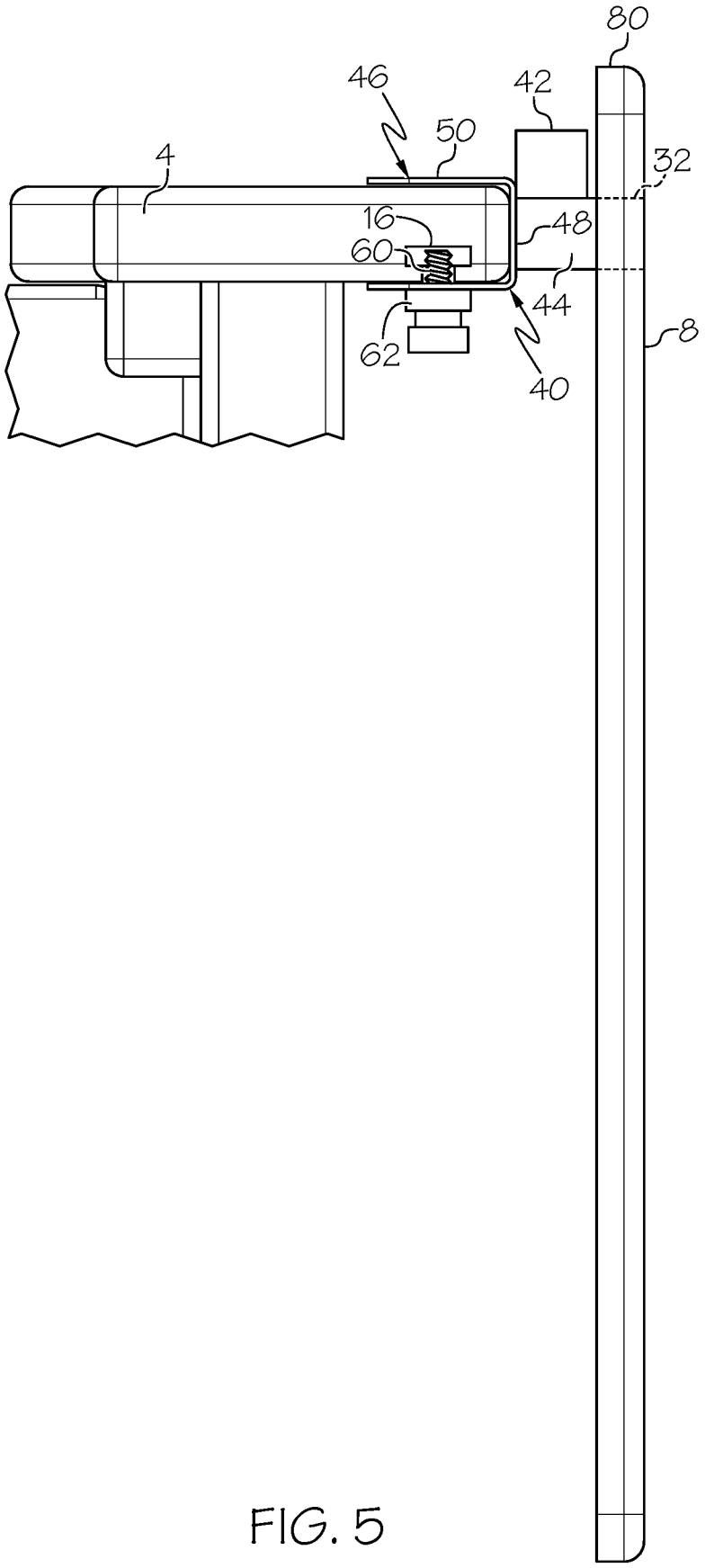
FIG. 5 is an end view of the tray mounted to the armrest in the storage position.

As shown in FIG. 4, the center of opening 32 is spaced from the outer end 80 a distance greater than the distance from the center of opening 32 to the outer end of second mount 44 such that outer end 80 of tray 8 covers second mount 44 when tray 8 is in the position of FIG. 1. This stops people who are walking past chair 2 from becoming snagged on second mount 44. As shown in FIG. 5, the center of opening 32 is spaced from the outer end 80 a distance greater than the distance from the center of opening 32 to the outer end of first mount 42 such that outer end 80 of tray 8 is located above first mount 42 when tray 8 is in the position of FIG. 5. This helps to limit snagging on the top of first mount 42 when tray 8 is in the storage position. Also as shown in FIG. 5, second mount 44 only extends a distance from first mount 42 a distance about the same as the thickness of the tray body so that tray 8 is close to first mount 42 when tray 8 is in the storage position.

Mounting assemblies 10 or 40 can be used with an item of furniture that is not designed for seating. An example is the table depicted in FIG. 6 wherein a portion of the table next to an edge is configured to receive the U-shaped portion of mounting assembly 10 or 40 so that cup holder 6 or tray 8 can be carried by the table.

Figure 6:
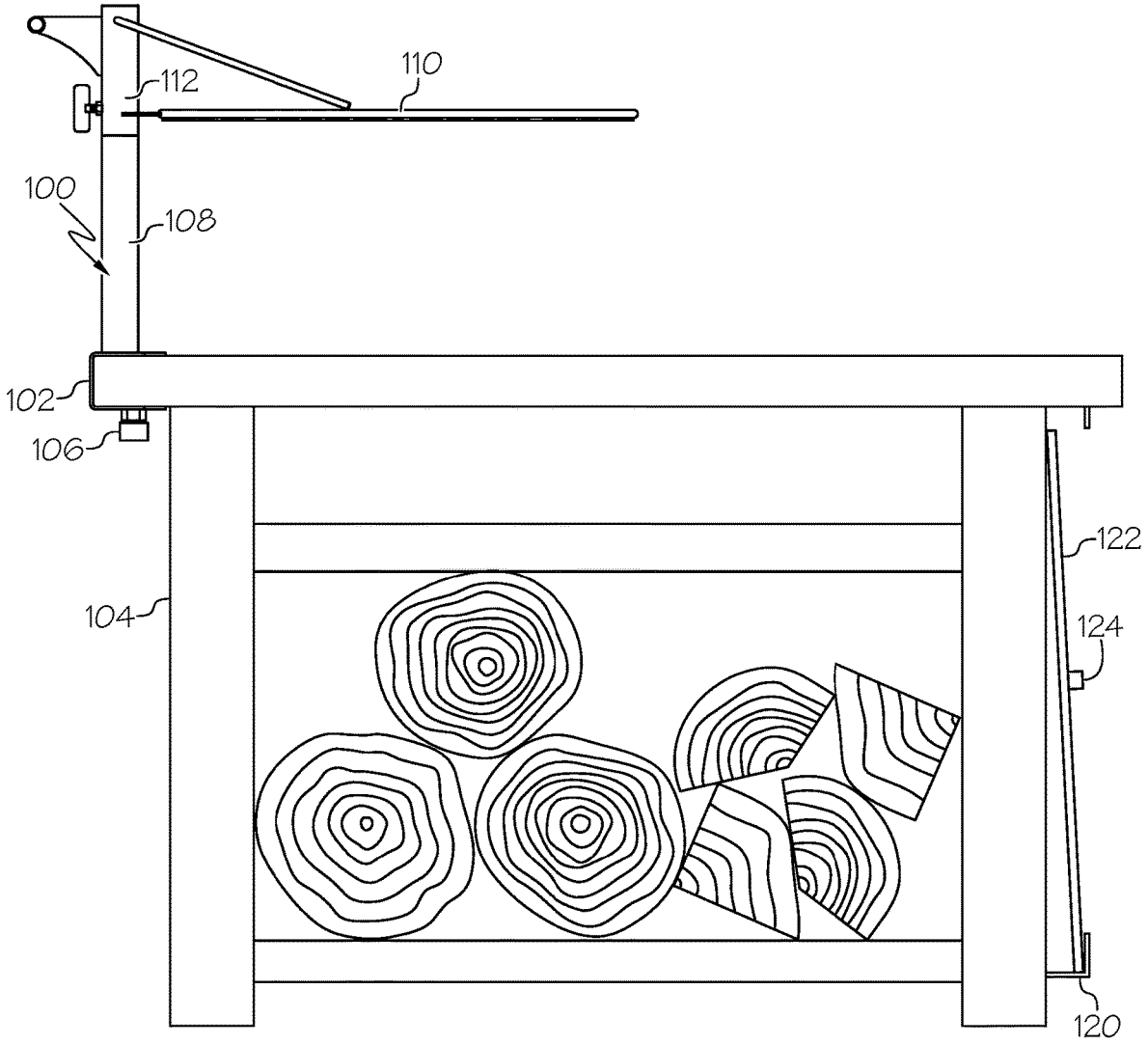
FIG. 6 is a front view of a table with a grill mounting post that allows the table to be used to hold a grill.
Figure 7:
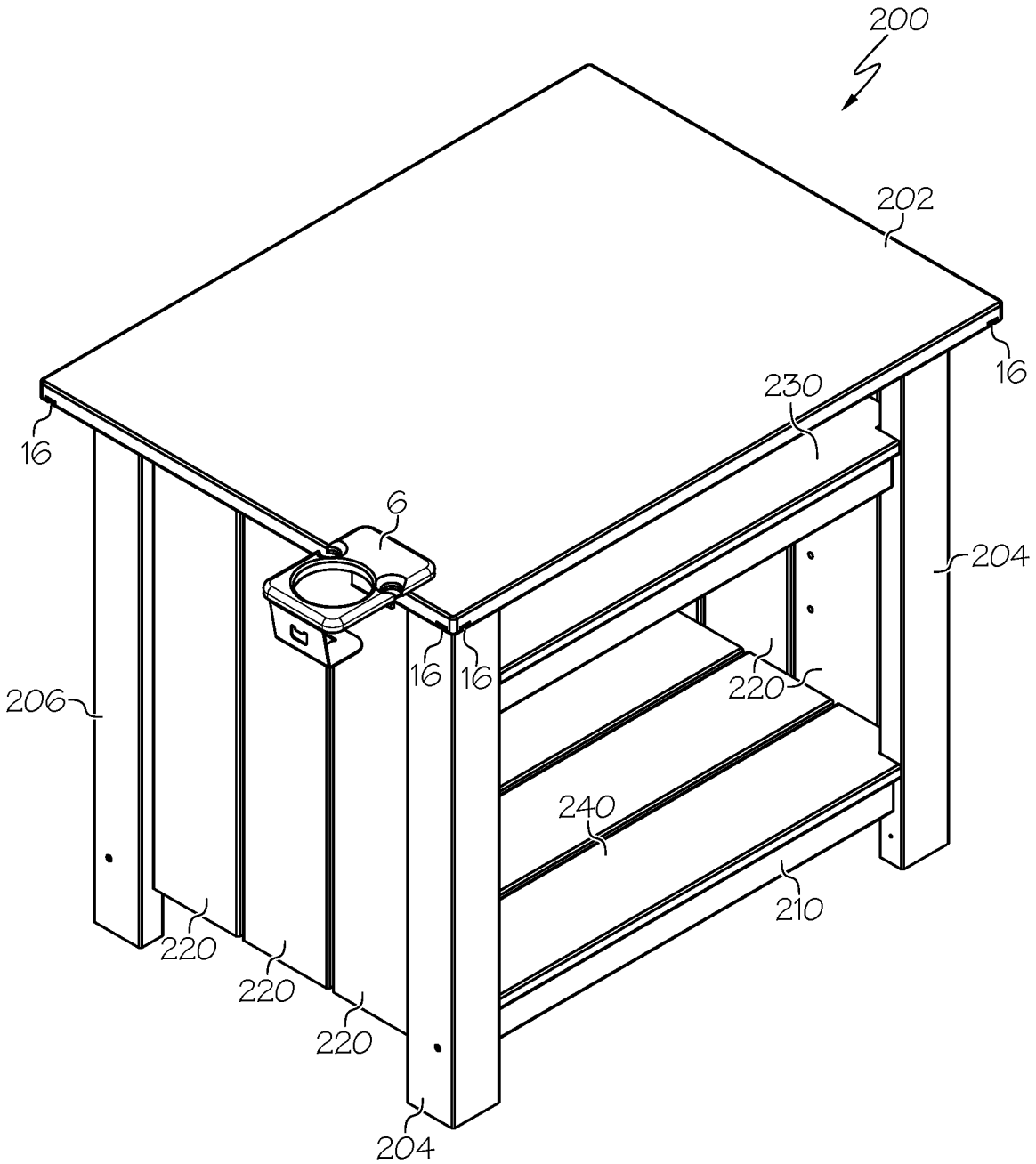
FIG. 7 is a perspective view of another table with storage feature relevant to a fire pit.

An exemplary grill holder is indicated generally by the number 100 in FIG. 6. Grill holder includes a U-shaped bracket 102 that mounts to an edge of a piece of furniture such as the table 104 depicted in FIG. 6. A locking finger 106 is connected to bracket 102 and can be used in the manner described above to secure bracket 102 to furniture 104 which can optionally include slot 16. A hollow grill mount tube 108 extends up from bracket 102 and receives a downwardly projecting grill post (for example, the lower portion of item #60 from US publication 2021/0045578 which is incorporated herein by reference to describe grill post #60) of a grill 110 that extends down from a grill tube 112. Grill holder 100 can this be connected to an item of furniture to allow a user to load the grill 110 before the grill 110 is placed on the fire and allows the user to remove a grill from the fire and remove the cooked food from the grill.

In the exemplary configuration, furniture 104 is a table that has a wood storage bin. The weight of the wood helps stabilize the table when a heavily loaded grill is connected to grill holder 100.

Table 104 includes a storage rack 120 for a circular cover 122 (with handle 124) for a fire pit. Rack 120 includes a lower shelf or spaced protrusions upon which the lower portion of cover 122 rests. An upper finger projects down from the underside of the table top to prevent cover 122 from falling out to the right in FIG. 6. Cover 122 may be removed by rolling or sliding it out of the ends or moving it past the upper finger and tilting it out to the right.

Another exemplary configuration of a table is indicated generally by the number 200 in FIGS. 7-13. The body of table 200 includes a table top 202 supported on a support structure that includes at least three legs with four legs shown in the exemplary configuration. The legs include two front legs 204 and two rear legs 206. Legs 204 and 206 can be solid. Legs 204 and 206 also can be hollow such as metal (stainless steel or aluminum) open tubes with flanges to which frame members are connected. Threaded height-adjustable feet are optionally connected to the bottom of legs 204 and 206. Table top 202 defines constant-width slots or T-slots 16 along the underside of its overhanging edges so that accessories such as cup holder 6 can be supported from table 200. Table 200 can be made from a polymer lumber product that resists weather. Table 200 also can be made from metal, polymer, or wood.

A front lower frame member 210 extends between the lower portions of front legs 204. A front upper frame member extends between the upper portions of front legs 204 under table top 202. Similarly, upper and lower side frame members extend between the upper and lower portions of front 204 and rear 206 legs behind the side walls (defined by slats 220). An upper shelf 230 is carried on pegs that fit into openings defined by the inner surfaces of some of slats 220. The position of shelf 230 can be adjusted by moving the pegs to different openings. A lower shelf 240 is carried on the lower side frame members. Like the side walls, lower shelf 240 can be formed from a plurality of slats. Similar to the FIG. 6 configuration, lower shelf 240 can be used to store wood for the fire pit.

Figure 8:
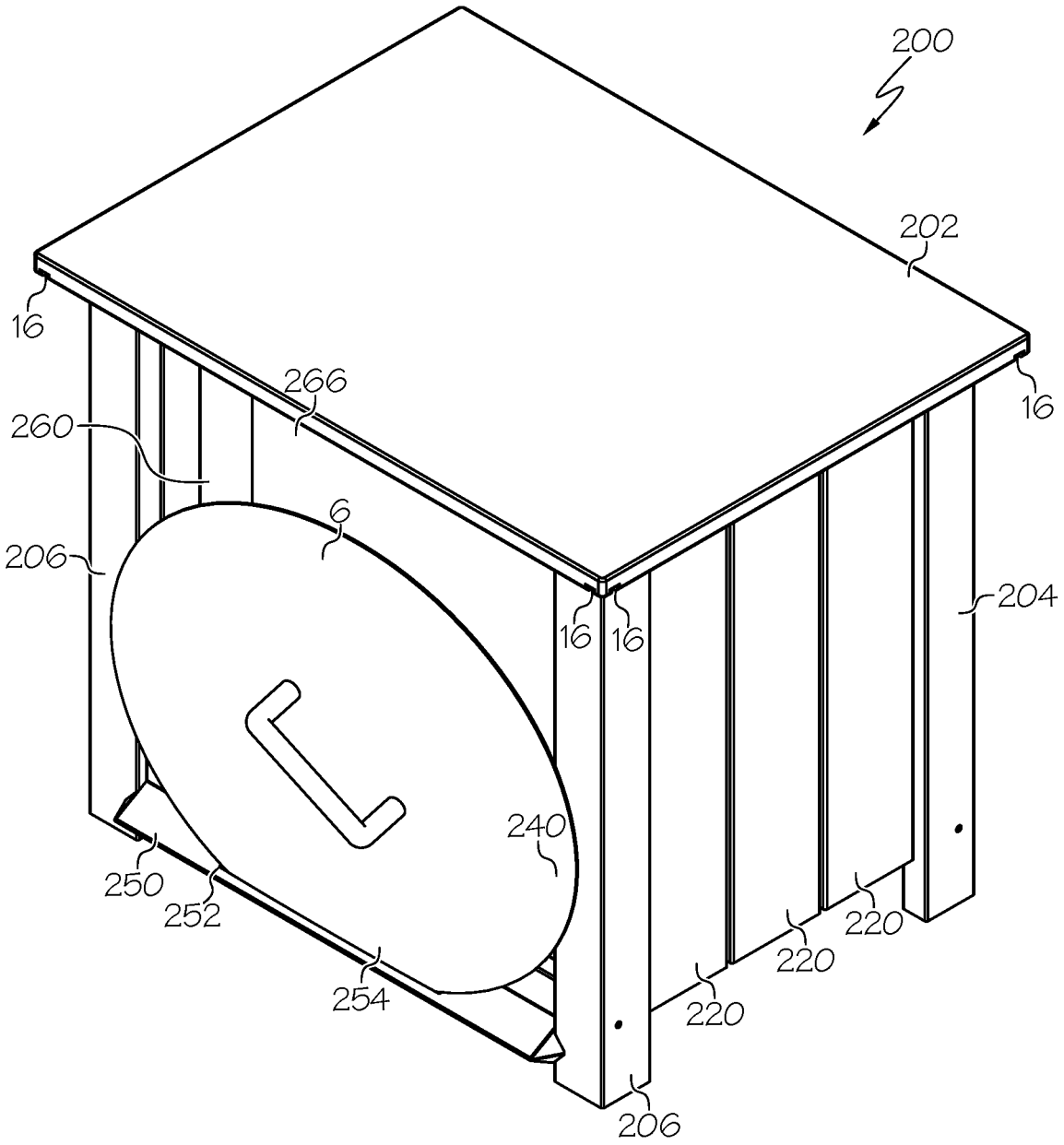
FIG. 8 is a rear perspective view of the table of FIG. 7 showing a fire pit cover stored in a holder.
Figure 9:
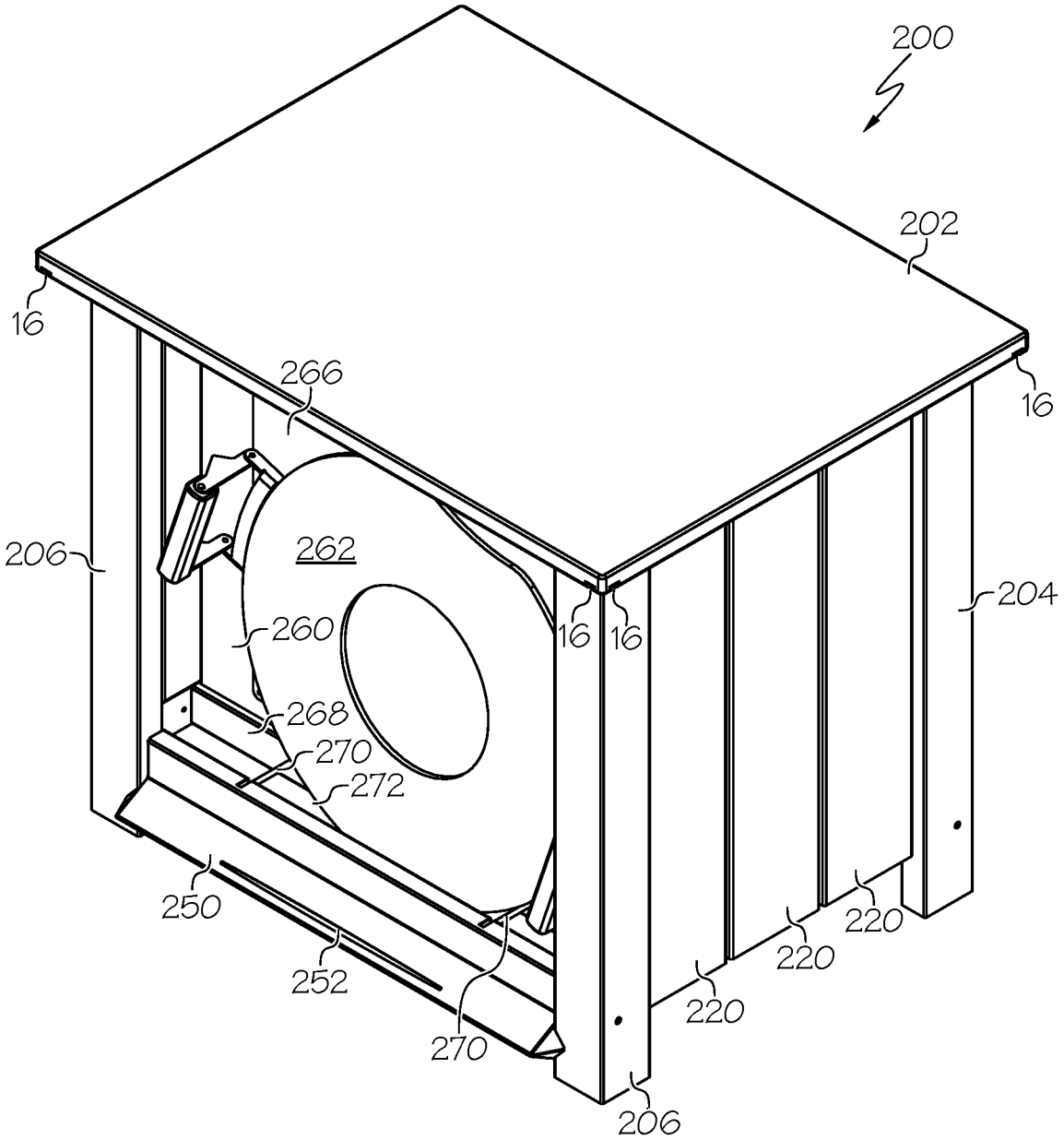
FIG. 9 is a rear perspective view of the table of FIG. 7 showing a fire pit griddle stored in a holder.
Figure 10:
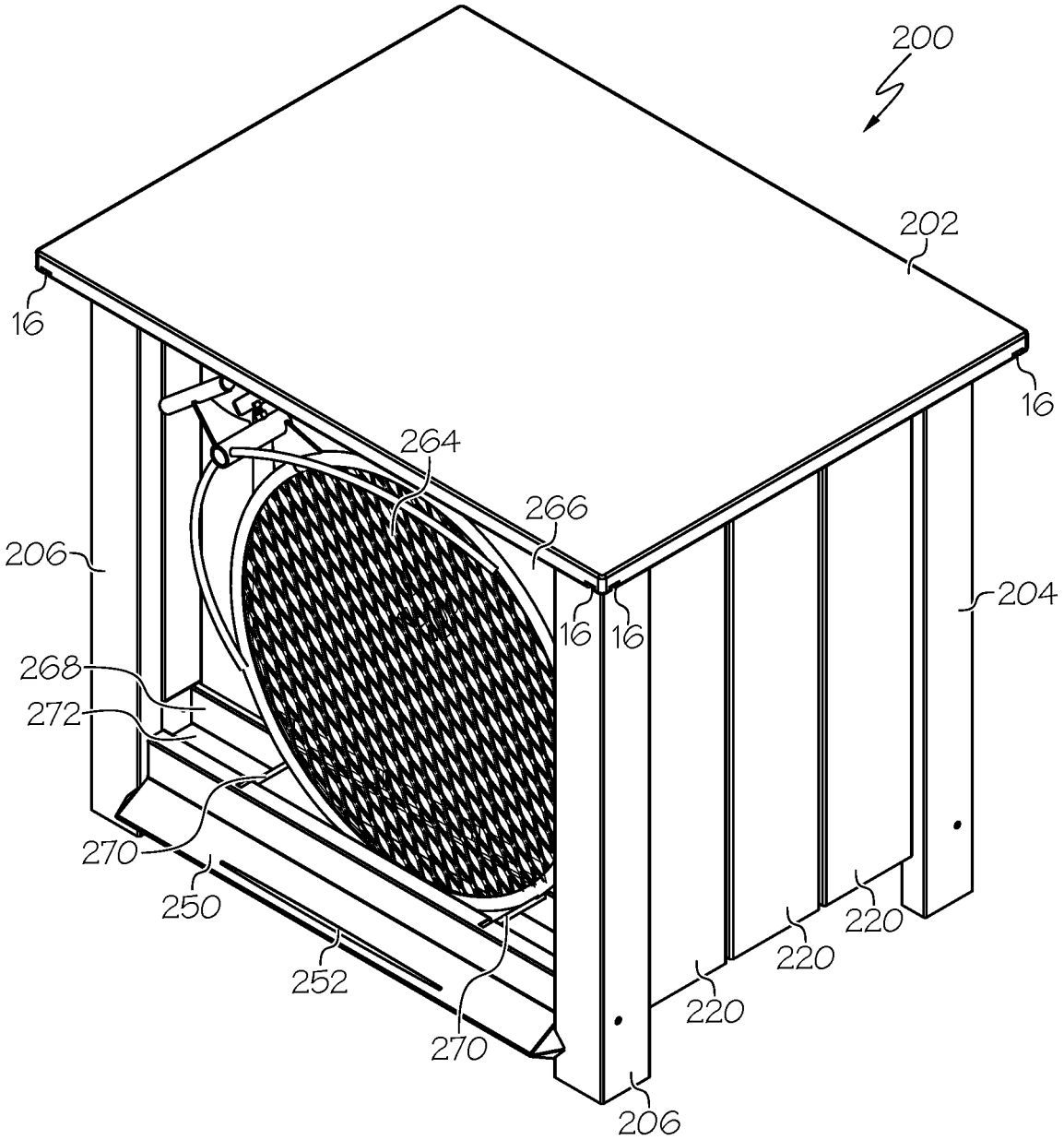
FIG. 10 is a rear perspective view of the table of FIG. 7 showing a fire pit grill stored in a holder.

A holder 250 extends between the lower portions of rear legs 206. Holder is metal (such as stainless steel or aluminum) and defines a slot 252 sized to receive a portion of the edge of a fire pit cover 254 so that cover 254 can be stored in table 200 when not in use. Holder 250 projects outwardly beyond the rear surfaces of legs 206 so that cover 254 is rearward of rear legs 206 when in storage as shown in FIG. 8.

The rear wall 260 of table 200 is spaced inwardly from rear legs 206 to define a space to receive a griddle 262 or a grill 264. Rear wall 260 can be formed from a plurality of slats. A metal heat shield 266 is carried on the rearwardly-facing surface of rear wall 260 to protect rear wall 260 from a hot griddle 262 or grill 264 so that they can be stored after being removed from use on the fire pit. A metal rear lower frame member 268 extends across the bottom of rear wall 260. A metal rear upper frame member extends across the top of rear wall. Two metal supports 270 extend between holder and frame member 268. Supports 270 can be rod-shaped. Griddle 262 and grill 264 can rest on supports 270 and against heat shield 266 or metal rear upper frame member. An opening 272 is defined between holder 250 and member 268 to provide air circulation about the lower portions of griddle 262 and grill 264 and to allow portions of griddle 262 and grill 264 to extend down below supports 270.

Figure 11:
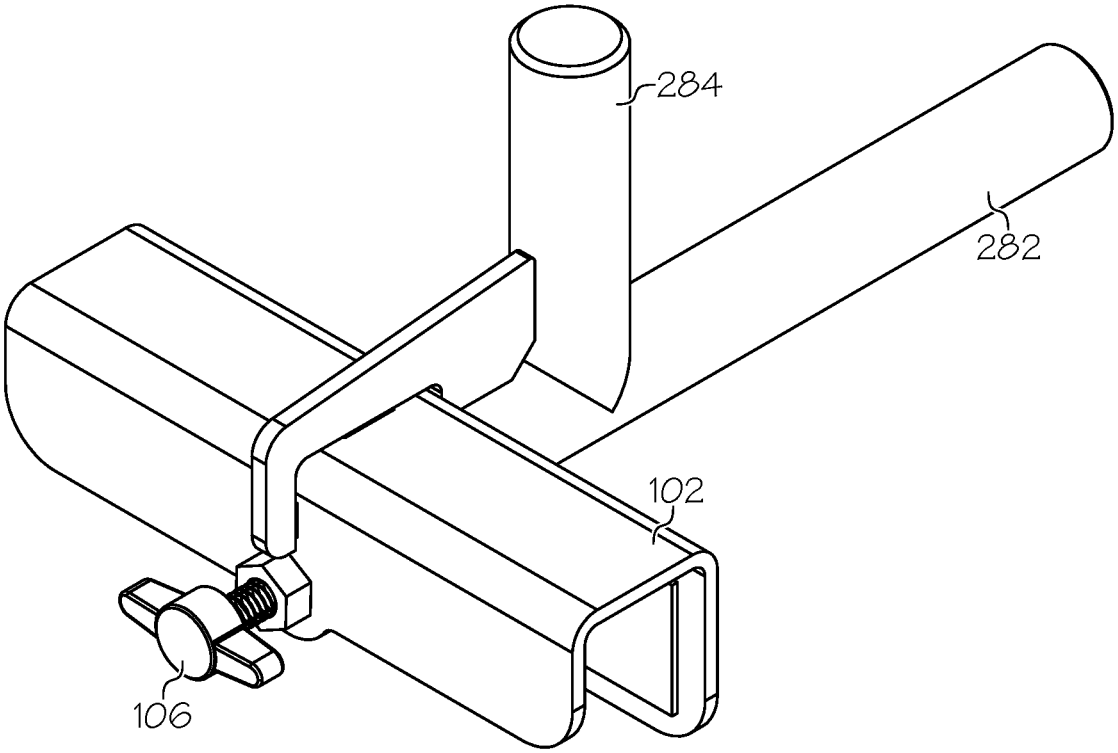
FIG. 11.
Figure 12:
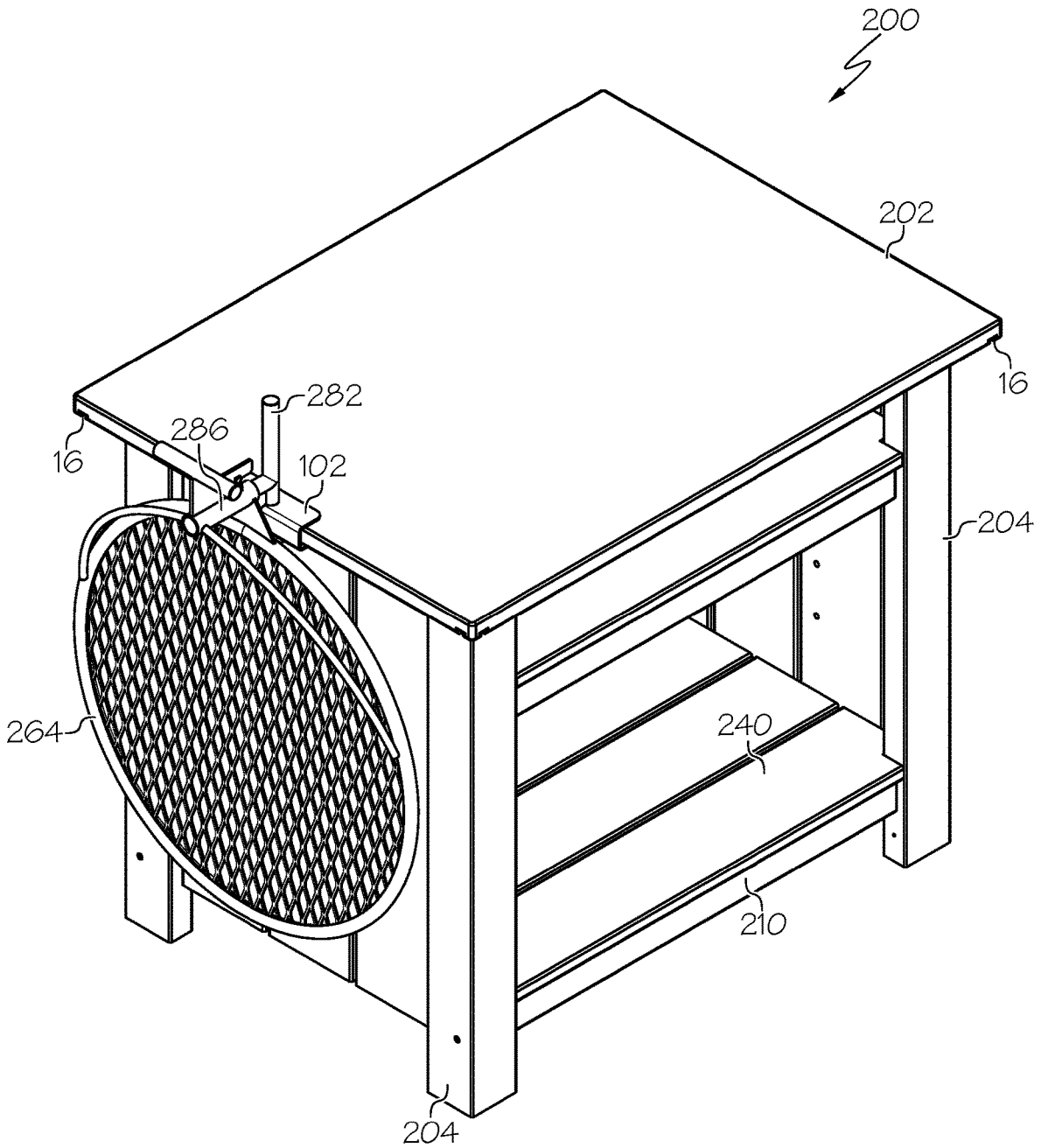
FIG. 12 is a perspective view of a grill carried in a storage position by the grill mount of FIG. 11.
Figure 13:
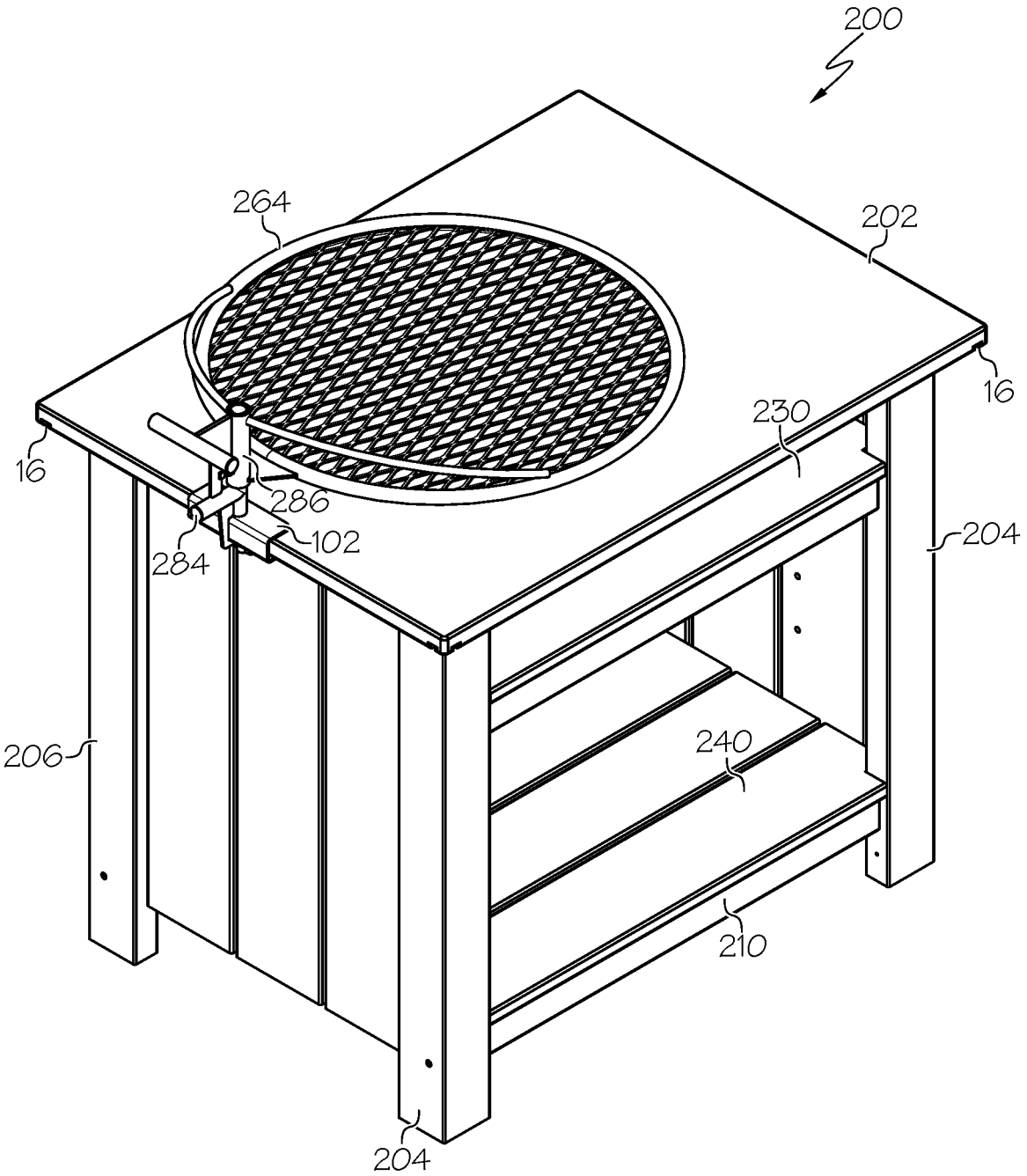
FIG. 13 is a perspective view of a grill carried in a usable position by the grill mount of FIG. 11.

Another grill mount 280 is depicted in FIGS. 11-13. Grill mount 280 includes the U-channel 102 as described above with fastener 106. In this configuration, grill mount includes a first vertical grill mount 282 and a second horizontal grill mount 284. Grill 264 includes a mounting tube 286 which allows grill 264 to be to an accessory post. The same mounting tube 286 slides over mounts 282 and 284 to mount grill 264 to grill mount 280. In FIG. 12, grill 264 is mounted to second horizontal mount 284 such that grill 264 hangs in a storage position along the side of table 200. In FIG. 13, grill 264 is mounted to first vertical mount 282 such that grill 264 is horizontal and can hold food. Also, grill 264 can rotate 360 degrees on mount 282 so that it can be positioned over table 200 or off to the side of table so that the table top can be used for other items.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the descriptions and illustrations are exemplary and the following claims are not limited to the exact details shown or described. Modifications and alterations of these embodiments will be apparent to one who reads and understands this general description. The present disclosure should be construed as including all such modifications and alterations insofar as they come within the scope of the following claims or equivalents thereof. Throughout the description and claims of this specification the words "comprise" and "include" as well as variations of those words, such as "comprises," "includes," "comprising," and "including" are not intended to exclude additives, components, integers, or steps.

The invention claimed is:

1. An item of furniture comprising:

a body;

an accessory mount repositionably carried by the body;

the accessory mount including a bracket that engages the body to support the accessory mount from the body;

the accessory mount including a first mount that projects upwardly with respect to the bracket and a second mount that projects outwardly from the body and with respect to the bracket;

the first mount being positioned to support an accessory in a useable position; and the second mount being positioned to support the accessory in a storage position.

2. The furniture of claim 1, wherein the body includes an armrest and the accessory is a tray; the bracket engaging the armrest.

3. The furniture of claim 2, wherein the tray is selective pivotable with respect to the first mount when the tray is in the useable position.

4. The furniture of claim 3, wherein the tray defines a mounting opening that selectively receives the first mount when in the useful position and the second mount when in the storage position.

5. The furniture of claim 1, wherein the body includes a table top and the accessory is a grill; the bracket engaging the table top.

6. The furniture of claim 5, wherein the grill includes a hollow mount that selectively receives the first mount when in the useful position and the second mount when in the storage position.

7. The furniture of claim 1, further comprising a cup holder removably and repositionably connected to the body.

8. The furniture of claim 7, wherein the body defines an elongated slot; the cup holder including a bracket and a locking finger; the bracket having a first portion extending across a portion of the elongated slot with the locking finger being adjustably carried by the first portion such that a portion of the locking finger can be adjusted to be located in the elongated slot.

9. The furniture of claim 8, wherein the cup holder can be selectively slid along a length of the elongated slot.

10. The furniture of claim 1, wherein one of the mounts is connected to and projects from the bracket and the other of the mounts is connected to and projects from the mount that is connected to and projects from the bracket.

11. The furniture of claim 10, wherein each of the mounts has a cylindrical portion adapted to be received within a portion of the accessory.

12. An item of furniture comprising:

a body that includes an armrest;

an accessory mount repositionably carried by the armrest;

the accessory mount having a first mount and a second mount; a longitudinal axis of the first mount being perpendicular to a longitudinal axis of the second mount;

the first mount being positioned to support a tray in a useable position with respect to the body;

the second mount being positioned to support the tray in a storage position with respect to the body;

the tray being selectively pivotable with respect to the first mount when the tray is in the useable position;

the tray defining a mounting opening that selectively receives the first mount when in the useful position and the second mount when in the storage position; and a center of the mounting opening being spaced from an inner edge of the tray by a distance that is less than the distance from a center of first mount and an inner edge of the armrest.

13. The furniture of claim 12, wherein a center of the mounting opening is spaced from an outer end of the tray a distance greater than the distance from the center of the mounting opening to an outer end of the second mount when the tray is mounted to the first mount in the useable position.

14. The furniture of claim 12, wherein a center of the mounting opening is spaced from an outer end of the tray a distance greater than the distance from the center of opening to an outer end of the first mount when the tray is mounted to the second mount in the storage position.

15. The furniture of claim 12, wherein the body defines an elongated slot; the accessory mount including a bracket and a locking finger; the bracket having a first portion extending across a portion of the elongated slot with the locking finger being adjustably carried by the first portion such that a portion of the locking finger can be adjusted to be located in the elongated slot.

16. An item of furniture comprising:

a body;

an accessory mount repositionably carried by the body;

the accessory mount having a first mount and a second mount; a longitudinal axis of the first mount being perpendicular to a longitudinal axis of the second mount;

the first mount being positioned to support an accessory in a useable position with respect to the body;

the second mount being positioned to support the accessory in a storage position with respect to the body;

the body defining an elongated slot; the accessory mount including a bracket and a locking finger; the bracket having a first portion extending across a portion of the elongated slot with the locking finger being adjustably carried by the first portion such that a portion of the locking finger can be adjusted to be located in the elongated slot; and the elongated slot is T-shaped in cross section.

17. The furniture of claim 16, wherein the accessory mount can be selectively slid along a length of the elongated slot.

18. The furniture of claim 16, further comprising a cup holder removably and repositionably connected to the body.

19. The furniture of claim 18, wherein the cup holder can be selectively slid along a length of the elongated slot.

* * * * *